US010548378B2

(12) United States Patent
Mundt

(10) Patent No.: US 10,548,378 B2
(45) Date of Patent: Feb. 4, 2020

(54) SUN PROTECTION DEVICE HAVING SOLAR PANELS

(71) Applicant: Pascal Mundt, Berlin (DE)

(72) Inventor: Pascal Mundt, Berlin (DE)

( * ) Notice: Subject to any disclaimer, the term of this patent is extended or adjusted under 35 U.S.C. 154(b) by 0 days.

(21) Appl. No.: 15/738,845

(22) PCT Filed: Jun. 30, 2016

(86) PCT No.: PCT/DE2016/000260
§ 371 (c)(1),
(2) Date: Dec. 21, 2017

(87) PCT Pub. No.: WO2017/000931
PCT Pub. Date: Jan. 5, 2017

(65) Prior Publication Data

US 2018/0168300 A1 Jun. 21, 2018

(30) Foreign Application Priority Data

Jul. 2, 2015 (DE) ..... 20 2015 004 652 U

(51) Int. Cl.
*A45B 25/18* (2006.01)
*A45B 25/02* (2006.01)
*A45B 11/00* (2006.01)

(52) U.S. Cl.
CPC ..... *A45B 25/18* (2013.01); *A45B 25/02* (2013.01); *A45B 2011/005* (2013.01); *A45B 2200/1027* (2013.01)

(58) Field of Classification Search
CPC ..... A45B 25/18; A45B 25/24
USPC ..... 135/34.2, 33.4, 33.41
See application file for complete search history.

(56) References Cited

U.S. PATENT DOCUMENTS

| | | | | |
|---|---|---|---|---|
| 174,430 | A * | 3/1876 | Onderdonk | A45B 25/02 135/31 |
| 699,424 | A * | 5/1902 | Stouder | A45B 25/18 135/33.4 |
| 2,582,749 | A * | 1/1952 | December | A45B 25/18 135/33.5 |
| 4,935,995 | A * | 6/1990 | Daus, Jr. | A45B 25/18 160/351 |
| 6,371,140 | B1 * | 4/2002 | Atanda | A45B 25/143 135/16 |
| 9,088,181 | B2 | 7/2015 | Akin et al. | |
| 2014/0028242 | A1 * | 1/2014 | Akin | H02J 7/35 320/101 |
| 2014/0332043 | A1 | 11/2014 | Glatz | |

FOREIGN PATENT DOCUMENTS

| | | |
|---|---|---|
| CN | 201831069 U | 5/2011 |
| DE | 3721830 A1 | 1/1989 |
| DE | 202009017001 U1 | 5/2010 |

(Continued)

*Primary Examiner* — Noah Chandler Hawk
(74) *Attorney, Agent, or Firm* — Smartpat PLC

(57) ABSTRACT

The invention relates to a sun protection device comprising a base body and a support structure for a clampable surface structure, the structure having a plurality of support elements, and a device for the utilization of solar energy, characterized in that the support elements (1; 10) divide the surface structure (7; 17) in covering regions (7.1, 7.2; 17.1, 17.2) and in that at least one support element (1; 10) is designed as a solar panel.

18 Claims, 4 Drawing Sheets

(56) References Cited

FOREIGN PATENT DOCUMENTS

| | | | | |
|---|---|---|---|---|
| DE | 202010002673 | U1 | 7/2010 | |
| DE | 202010006758 | U1 | 11/2010 | |
| DE | 202012000527 | U1 | 1/2013 | |
| DE | 202012009833 | U1 | 1/2013 | |
| DE | 202013004266 | U1 | 5/2013 | |
| WO | WO-9213470 | A1 * | 8/1992 | ..... A45B 15/00 |

* cited by examiner

SUN PROTECTION DEVICE HAVING SOLAR PANELS

CROSS-REFERENCE TO RELATED APPLICATIONS

This application is an U.S. national phase application under 35 U.S.C. § 371 based upon co-pending International Application No. PCT/DE2016/000260 filed on Jun. 30, 2016. Additionally, this U.S. national phase application claims the benefit of priority of co-pending International Application No. PCT/DE2016/000260 filed on Jun. 30, 2016 and German Application No. 20 2015 004 652.5 filed on Jul. 2, 2015. The entire disclosures of the prior applications are incorporated herein by reference. The international application was published on Jan. 5, 2017 under Publication No. WO 2017/000931 A1.

BACKGROUND OF THE INVENTION

Field of the Invention

The present invention relates to a sun protection device having a base body and a support structure for a flat structure that can be extended over it, the structure having a multiplicity of support elements, and also a device for utilizing solar energy.

Description of the Prior Art

Such sun protection devices are known, for example, from DE 20 2012 009 833 U1 or DE 20 2009 017 001 U1. In this prior art, solar panels are mounted on a top side of the shade.

DE 2010 002 673 U1 and DE 20 2010 006 758 U1 describe films and foils for use as a covering material of a parasol.

The above two groups of sun protection devices are mentioned here are representative of a plurality of similar designs, all of which comprise as part of their contents either a covering of panels on a shade surface or a texture of the covering material of the shade surface itself.

In both cases, the practical implementation is not successful, because the sun protection devices cannot be moved back and forth between an operating position and a rest position at all, or at least only to a very limited extent. This considerably limits them in terms of their function.

The covering layer of solar panels on the surface of a parasol impedes, for example, the formation of folds when collapsing a parasol. Panels on the top of the parasol require the sun protection device to be permanently opened out, even in rain and stormy weather.

The covering of a parasol made from a photovoltaic foil or film is also not flexible enough to enable what is normally an easy folding action when collapsing the parasol. Foils and films are indeed flexible, but compared to textile materials they continue to have a much greater stiffness.

In both cases, the normal operation of a parasol with either solar panels or else covering materials suitable for solar energy is significantly limited in comparison to a standard textile covering.

BRIEF SUMMARY OF THE INVENTION

The object of the present invention, therefore, is to extend a sun protection device of the aforementioned type in such a way that with such a device, solar energy can be absorbed and utilized without restricting the operation of the device when changing between the operating position and the rest position.

The object is achieved according to the invention by the fact that the support elements divide the flat structure into covering sections and that at least one support element is designed as a solar panel.

The present invention implements the idea of equipping a sun protection device with solar panels without impairing the folding technology, and therefore the operation of the sun protection device. Thus, a sun protection device as a result of the invention can still be either partially extended, fully extended or not extended at all, depending on the level of shading desired, exactly as is possible with conventional sun protection devices. No special consideration for solar panels is required. The idea is implemented in a way which ensures that the support elements present in conventional sun protection devices are used as solar collectors. In the case of parasols, for example, these are the radial spokes. With this design, the sun protection devices can continue to be covered with the usual textile fabrics, the folding fabric of which can be produced easily and with only a small amount of resistance.

With the present invention, it is possible with standard sun protection devices to provide power for electrical and/or electronic consumers, such as mobile media devices, sound systems, lighting systems, WIFI networking, etc. Thus, the solar collector becomes a part of the construction of the sun protection device and therefore does not remain just a separate component from the sun protection device which must first be physically connected to the latter, as in the state of the art.

Another advantage of the present invention is that the at least one support element has a collector plate, which overlaps over at least one adjacent flat structure. This allows the collector surface area to be made larger than a cross-sectional area of the respective support element. The overlapping of the collector plate can be provided on one or both sides. For example, if the radial spokes of a parasol are designed as support elements that overlap the collector plate, then the width of each collector plate, extending at right angles to the radial length of the spokes, can be chosen such that the collector plates fully enclose the shade body in the collapsed rest position, and form a protective cover for the textile covering material.

A further advantage of the present invention is that the at least one support element has a tensioning device for tensioning the flat structure. The tensioning by means of a tensioning device on the support element ensures that each covering section separated by a support element is optimally tensioned in the operating position.

Another advantage of the present invention is that the flat structure is arranged between the tensioning device and the at least one support element. It is thus possible to provide, for example, a uniform flat structure, which in the extended state, in other words in the operating position, can be clamped or re-clamped to the respective at least one support element.

Another advantage of the present invention is that at least one support element and the tensioning device are formed as a single piece in a simple embodiment. In this uniform design, the ends of one covering section adjoining the at least one support element on both sides are firmly clamped in the at least one support element. This fixed tensioning is effected in an advantageous way due to the fact that the respective ends of the two covering sections, which adjoin the at least one support element, have stiffeners that engage in designated spaces of the support element with a form-fit and a force-fit.

A further advantage of the present invention is that in other embodiments the at least one support element is designed in two parts. In this other embodiment, the tensioning device is designed in the form of a clip, and clamps either one end of the covering sections adjoining on both sides or one section of the single-piece, continuous flat structure between itself and the at least one support element.

A further advantage of the present invention is also that a support channel is formed in the at least one support element, in the longitudinal direction of the at least one support element, in which an electrical device for the solar collectors can be accommodated.

Further advantages of the following invention result from the additional features of the dependent claims.

BRIEF DESCRIPTION OF THE DRAWINGS

Embodiments of the present invention will be described in more detail in the following by reference to the drawing. Shown are.

DETAILED DESCRIPTION OF THE INVENTION

The embodiments of the present invention are described using the example of a parasol. However, the present invention is in fact not restricted to the practical embodiment of a parasol. Instead, the support elements, which are adapted to a parasol, can be adapted to the practical circumstances in other embodiments in a similar way.

Figure 1:
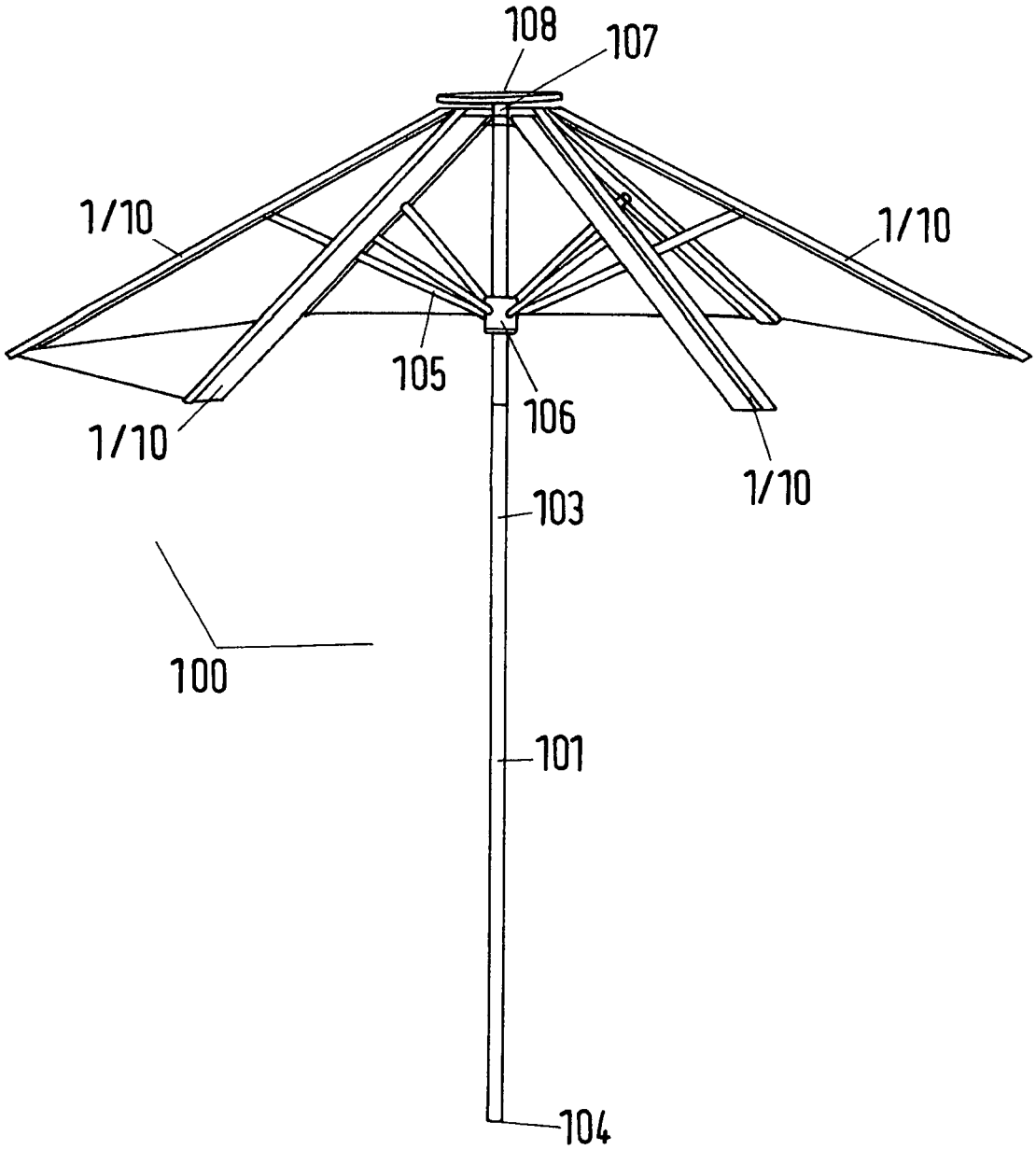
FIG. 1 a schematic view of a sun protection device in accordance with the present invention in the form of a parasol in a fully extended operating state.

FIG. 1 shows a schematic representation of a sun protection device 100 as a parasol in a fully extended operating position. The sun protection device 100 has a base body 101, which comprises a rod 103 having a free end 104 for fixing in a stand (not shown), and a support structure compose of a plurality of support elements 1/10. In the operating position shown, the support elements 1/10 are supported on the rod 103 via support arms 105 and a sleeve 106. The support elements 1/10 are hinge-connected to an end 107 of the rod 103 opposite to the free end 104. In this way, a displacement of the sleeve 106 along the rod 103 allows the support elements 1/10 to be moved into the operating position shown or into a rest position, in which the support elements 1/10 are positioned roughly parallel to the rod 103. At the end 107 of the rod 103 is located a plate-like termination 108.

Figure 2:
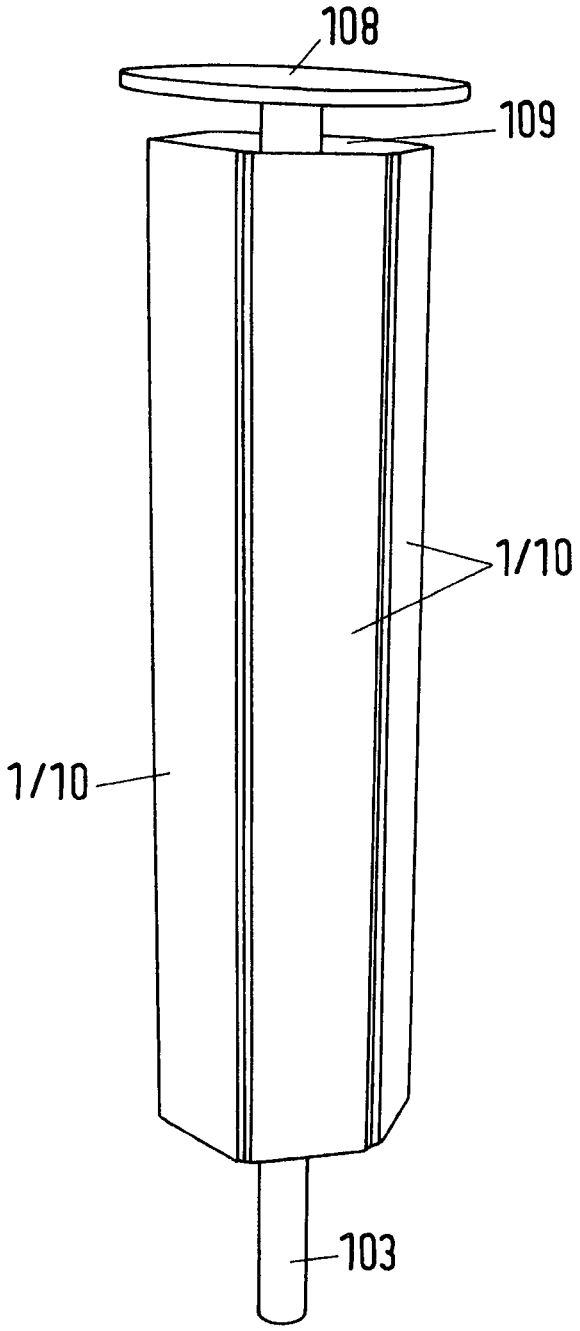
FIG. 2 a schematic view of a sun protection device in accordance with the present invention in the form of a parasol in a collapsed rest state.

FIG. 2 shows the sun protection device of FIG. 1 in a slightly magnified form in a collapsed rest position. The support elements 1/10 in the embodiment shown form an almost closed cover. The plate-like termination 108 has such a diameter that it completely covers an opening area 109 which appears in the rest position.

The terms "operating position" and "rest position" refer only to the sun protection function of the sun protection device 100. An additional intended function of the sun protection device, namely the energy recovery, is also active or can be activated in the rest position.

Figure 3:
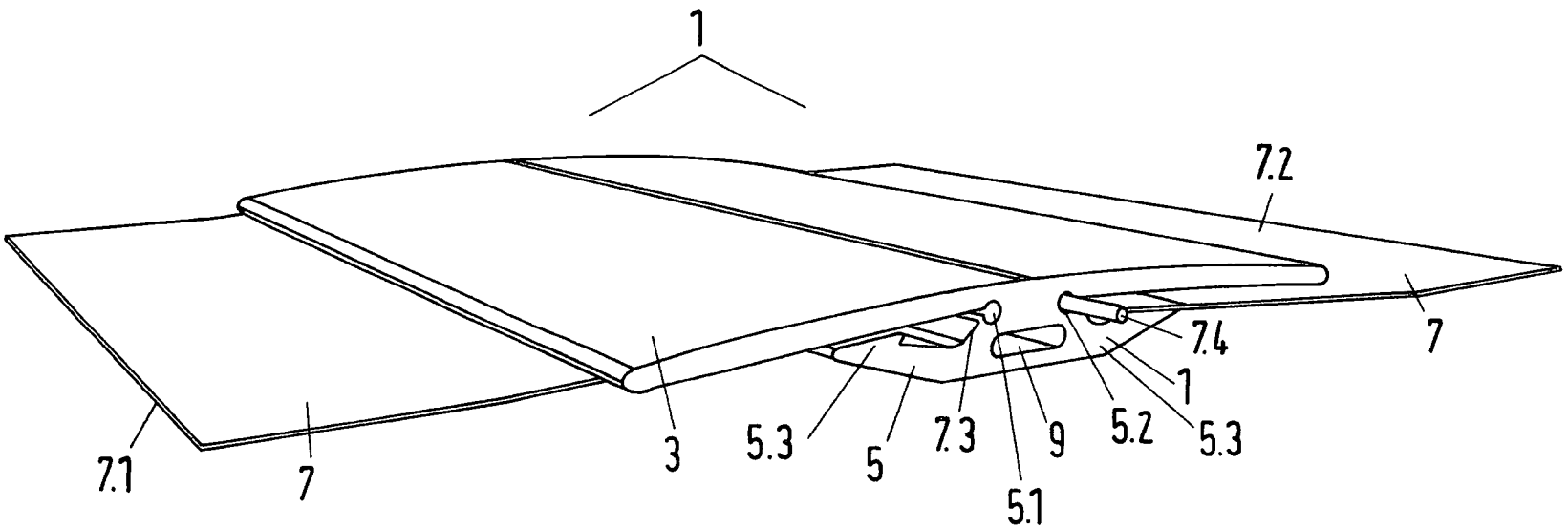
FIG. 3 a schematic cross-sectional view of a support element for a sun protection device in accordance with the present invention in a first embodiment.

FIG. 3 shows a schematic representation of a support element 1 of a sun protection device 100 in accordance with the present invention in a first embodiment. The support element 1 in the first embodiment is designed as a single piece and comprises a collector plate 3 and a tensioning device 5. The collector plate 3, both in an operating position and in a resting position of the parasol, in other words in a fully extended state or a collapsed state of a parasol, forms the side facing the sun, on which the solar radiation will be incident. The collector plate 3 carries solar panels that are not shown separately here. Their design and construction is generally known and not the subject of the present invention.

The parasol has a flat structure 7, which consists of a textile material, for example. The flat structure 7 is not restricted to a textile material however, but can comprise any materials that are commonly used, for example, for parasols and awnings. Examples of such materials are paper-based materials and plastics.

In the embodiment shown in FIG. 3, the flat structure 7 is sub-divided into a first covering section 7.1 and a second covering section 7.2. The at least one support element 1 is also used for connecting the first covering section 7.1 and the second covering section 7.2. To achieve this, between the collector plate 3 and the tensioning device 5, an area 5.1, 5.2 is formed to which one side of the first covering section 7.1 or the second covering section 7.2 can be fixed or clamped. In order that this functions properly, the first covering section 7.1 has a stiffener 7.3 on this side and the second covering section 7.2 has a stiffener 7.4 on this side. In the embodiment shown, the respective stiffener 7.3, 7.4 had a round cross-section, which fits tightly into the corresponding area 5.1 and/or 5.2 of the tensioning device 5.

The collector plate 3 overlaps the respective covering section 7.1, 7.2, and has a slightly convex curvature towards the sun corresponding to the curvature of a fully extended parasol. In the area of the respective overlap of the collector plate 3 the tensioning device 5 has a support element 5.3, which is preferably also designed slightly elastic and with its spring action is stretched upwards in the direction of the underside of the respective covering section 7.1, 7.2. This ensures a fixed clamping of the flat structure 1 with its respective covering sections 7.1, 7.2 in the support element 1.

In the tensioning device 5 in the present embodiment in FIG. 1 a central channel 9 is formed, which can accommodate an electrical supply device for the solar collectors.

Figures 4A, 4B:
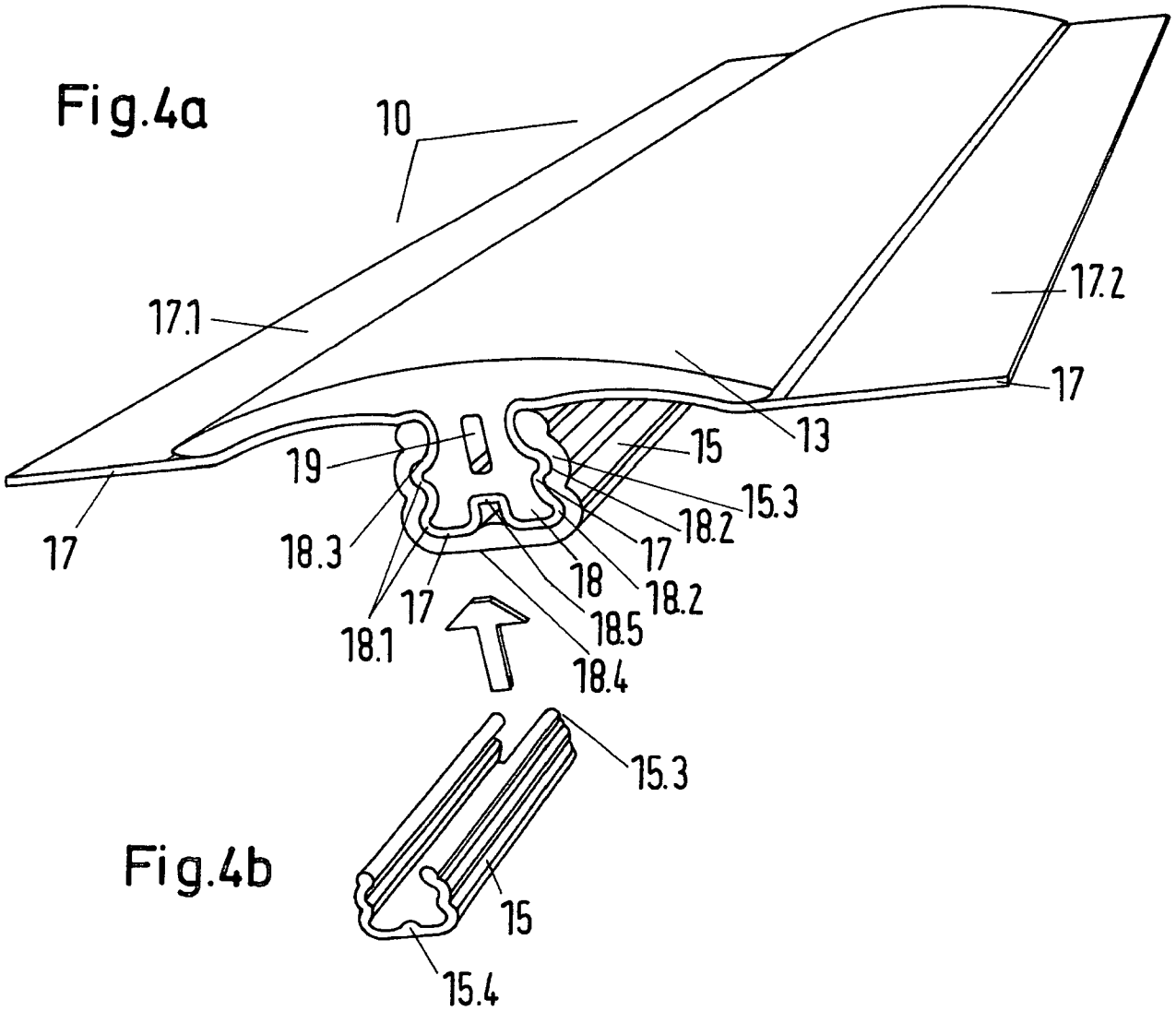
FIG. 4*a* a schematic cross-sectional view of a support element for a sun protection device in accordance with the present invention in a second embodiment.
FIG. 4*b* a schematic representation of a tensioning device for a support element of FIG. 4*a*.

FIG. 4*a* shows a schematic representation of a second embodiment of the present invention.

In the second embodiment, a support element 10 of a sun protection device in accordance with the present invention is formed from multiple pieces and comprises, in particular, a collector plate 13 and a tensioning device 15. In an operating position, thus in a fully extended state of a parasol, the collector plate 13 forms the side which is facing toward the sun, on which the solar radiation will be incident. The collector plate 13 carries solar panels that are not shown separately here. Their design and construction is generally known and is not the subject of the present invention.

The parasol has a flat structure 17, which consists of a textile material, for example. The flat structure 17 is not restricted to a textile material however, but can comprise any materials that are commonly used, for example, for parasols and awnings. Examples of such materials are paper-based materials and plastics.

In the embodiment shown in FIG. 4*a*, a flat structure 17 is sub-divided into a first covering section 17.1 and a second covering section 17.2, wherein the flat structure 17 is designed as a single piece, hence the sections are not physically separated from each other. The at least one support element 10 is also used for connecting the first covering section 17.1 and the second covering section 17.2. To this end, on a side of the collector plate 13 facing away from the sun, a fitting 18 is provided. At least one region 18.1, 18.2 is formed in this, to which one side of the first covering section 17.1 or of the second covering section 17.2 can be fixed or clamped.

On an underside 18.4 of the fitting 18 a recess 18.5 is formed, in which an internal attachment 15.4 of the tensioning device 15 can engage. At this point, by means of externally applied pressure and a spring action, the U-profile can be spread apart, so that the tensioning device 15 can be detached from the fitting 18 to release the flat structure 17.

A central channel 19 is formed in the fitting 18 to accommodate an electrical device for the solar collectors.

In FIG. 4*b* the tensioning device 15 is shown schematically. The arrow shows the direction in which the tensioning device 15 is mounted on the fitting 18 and on the flat structure which rests on said fitting 17.

The basic idea of the modular support elements can also be implemented with other types of garden furniture, such as laundry spiders, garden fences or their components.

REFERENCE LIST

First Embodiment

1 support element
3 collector plate
5 tensioning device
5.1 section
5.2 section
5.3 support element
7 flat structure
7.1 first covering section
7.2 second covering section
7.3 first stiffener
7.4 second stiffener
9 channel Second Embodiment

10 support element
13 collector plate
15 tensioning device
15.3 annular projection
15.4 internal attachment
17 flat structure
17.1 first covering section
17.2 second covering section
18 fitting
18.1 section
18.2 section
18.3 annular recess underside
18.4 underside
18.5 recess
19 channel

The invention claimed is:

1. A sun protection device comprising:
a base body; and
a support structure for a fabric structure extendable under tension, said support structure including
a plurality of support elements, and
a device for utilizing solar energy,
said support elements having a configuration capable of sub-dividing said fabric structure into covering sections,
wherein each of said support elements has a maximum width which exceeds a maximum height of the respective support element,
wherein each of said support elements includes a tensioning device configured to connect said covering sections under tension,
wherein at least one of the support elements includes
a collector plate, and
at least one solar panel associated with said collector plate, and
wherein the support elements jointly form a substantially closed outer cover when the sun protection device is in a collapsed rest position without the support elements interlocking one another.

2. The sun protection device according to claim 1, wherein said fabric structure is arranged between said tensioning devices and said support elements.

3. The sun protection device according to claim 1,
wherein said at least one support element further comprises a fitting which extends from said collector plate opposite said solar panel, and
wherein said collector plate and said fitting are formed as a single piece, and
wherein said tensioning device is a profile that is detachably connected to said fitting.

4. The sun protection device according to claim 3,
wherein said tensioning device and said fitting each has a U-profile, and
wherein said U-profiles of said tensioning device and said fitting have corresponding clamping regions.

5. The sun protection device according to claim 3, wherein an underside of said fitting defines a recess, and said tensioning device includes an internal attachment configured to engage with said recess when said tensioning device is clipped on to said fitting.

6. The sun protection device according to claim 3, wherein said fitting includes a support channel formed therein.

7. The sun protection device according to claim 3, wherein at least a portion of said fabric structure is clamped between said tensioning device and said fitting when said tensioning device is clipped on to said fitting.

8. The sun protection device according to claim 1, wherein said fabric structure is formed as a single piece.

9. The sun protection device according to claim 1,
wherein said covering sections are a plurality of physically separated parts and collectively form said fabric structure.

10. The sun protection device according to claim 9,
further comprising flexible stiffeners incorporated into ends of said physically separated covering sections which each adjoin said support elements,
said flexible stiffeners having a configuration capable of providing a fixed stationary position between said tensioning device and said support elements.

11. The sun protection device according to claim 1, wherein said at least one support element defines a support channel formed on a side of said at least one support element, said support channel facing away from the sun.

12. The sun protection device according to claim 11, wherein said support channel has a configuration capable of accommodating an electrical supply device for said device for utilizing solar energy.

13. The sun protection device according to claim 1, wherein said at least one support element, when facing the sun, is adapted in shape to an extended form of said fabric structure facing the sun.

14. The sun protection device according to claim 1, wherein said base body forms a parasol with said support structure.

15. The sun protection device according to claim 1, wherein said support elements are pivotably connected with said base body.

16. The sun protection device according to claim 1, wherein each said tensioning device and said support element are one piece.

17. The sun protection device according to claim 1, wherein said collector plate and said tensioning device are a single piece.

18. The sun protection device according to claim 1, further comprising a termination plate which forms an upper surface of the outer cover.

* * * * *